US006356185B1

(12) United States Patent
Plugge et al.

(10) Patent No.: US 6,356,185 B1
(45) Date of Patent: Mar. 12, 2002

(54) CLASSIC AUTOMOBILE SOUND PROCESSOR

(76) Inventors: Jay Sterling Plugge, 943-G La Mesa Ter., Sunnyvale, CA (US) 94086; Jason Carl Plugge, 1203 N. Owens St., Apt. #310, Stillwater, MN (US) 55082

( * ) Notice: Subject to any disclaimer, the term of this patent is extended or adjusted under 35 U.S.C. 154(b) by 0 days.

(21) Appl. No.: 09/610,310

(22) Filed: Jul. 5, 2000

Related U.S. Application Data

(60) Provisional application No. 60/161,702, filed on Oct. 27, 1999.

(51) Int. Cl.[7] ..... G08B 3/10

(52) U.S. Cl. ..... 340/384.3; 340/384.7; 381/61; 446/397

(58) Field of Search ..... 340/441, 692, 340/384.3, 384.7, 384.1; 446/410, 397, 409, 404; 381/61, 86; 704/278; 104/296, 272, 258

(56) References Cited

U.S. PATENT DOCUMENTS 5,237,617 A * 8/1993 Miller ..... 381/61
5,371,802 A * 12/1994 McDonald et al. ..... 381/71
5,635,903 A * 6/1997 Koike et al. ..... 340/441
5,754,094 A * 5/1998 Frushour ..... 340/384.7
5,820,442 A * 10/1998 Helder ..... 446/404
6,230,140 B1 * 5/2001 Severson et al. ..... 704/278

* cited by examiner

*Primary Examiner*—Brent A. Swarthout
(74) *Attorney, Agent, or Firm*—James J. Leary; Carol D. Titus

(57) ABSTRACT

An automobile sound processor containing prerecorded or synthesized sound signatures of vintage automobiles and motorcycles or other sounds, along with other audio processing components, is integrated with an automobile's on-board stereo sound system. A mode selector allows the user to select the desired classic car sound signature to be replicated. Sensors or transducers located in the engine compartment measure engine RPM and manifold vacuum. The sensors communicate instantaneous measurements of engine RPM and manifold vacuum to the sound processor and other audio processing components. The output of the sound processor is a composite audio replication of a selected sound signature. The sound signature is reproduced through the vehicle's on-board stereo sound system and modulated by the driving dynamics of the driver's car, as if the car were producing these sounds by responding to acceleration and deceleration dynamics.

23 Claims, 3 Drawing Sheets

CLASSIC AUTOMOBILE SOUND PROCESSOR

RELATIONSHIP TO OTHER APPLICATIONS

This application claims the benefit of U.S. Provisional application No. 60/161,702, filed Oct. 27, 1999, the entire disclosure of which is hereby incorporated by reference.

FIELD OF THE INVENTION

The present invention relates to sound processors and, more particularly, to a sound processor for producing simulated automobile or motorcycle engine sounds.

BACKGROUND OF THE INVENTION

An enjoyable aspect of driving a 50's, 60's or 70's classic automobile or motorcycle is the endearing and unique audible sound signature of that specific vehicle. The ability to produce these unique sounds in today's automobiles is difficult due to new engine technology and the limitations imposed by government mandated pollution controls. New automotive designs have concentrated on reducing road and engine noise, placing the driver in a more serene and quiet environment. Enthusiasts who once enjoyed the unique rumble and throaty sounds of the 1960's "muscle cars", such as a 327 Short Block Chevy, 427 Corvette, Ferrari, Dodge Hemi, or a Harley Davidson motorcycle, etc., cannot duplicate anything approaching these feelings in new automobiles.

The motivation of this invention is to return the joy and excitement of the 50's, 60's and 70's era when classic hot rod sounds were trademarks and a pleasurable part of the driving experience. Imagine the pleasure of riding down the road in your modern automobile, but with the throaty sound of a 327 Short Block V8 or the rumble of a Harley Davidson motorcycle emanating from a 'virtual'dual exhaust system.

SUMMARY OF THE INVENTION

The present invention takes the form of an automobile sound processor containing prerecorded or synthesized sound signatures of vintage automobiles and motorcycles or other sounds, along with other audio processing components, that is integrated with an automobile's on-board stereo sound system. A mode selector on the automobile sound processor or the vehicle's stereo system allows the user to select the desired classic car sound signature to be replicated. Sensors or transducers located in the engine compartment measure engine RPM and manifold vacuum. The sensors communicate instantaneous measurements of engine RPM and manifold vacuum to the sound processor and other audio processing components. The output of the sound processor is a composite audio replication of a selected sound signature. The sound signature is reproduced through the vehicle's on-board stereo sound system and modulated by the driving dynamics of the driver's car, as if the car were producing these sounds by responding to acceleration and deceleration dynamics.

The automobile sound processor includes a sound memory with one or more look-up-tables (LUT) programmed with unique broadband and high dynamic range sound signatures from various classic automobiles and/or motorcycles. The sound signatures could have been recorded from actual classic cars over an operating range from idle to maximum RPM. Each sound signature at each recorded RPM consists of a short temporal period that when continuously replayed sounds smooth and continuous.

Preferably, the automobile sound processor is adapted to replicate actual engine sounds under three conditions: 1) no-load, 2) loaded acceleration and 3) deceleration. The engine loading, as detected by the manifold vacuum sensor is used to modulate an audio filter that processes the output of the audio processor to change the tonal character of the sound signature thus reflecting the audible changes characteristic of the strain of the engine. If the engine is under load, the vacuum will decrease and the audio filter will accentuate low frequencies while suppressing some of the higher frequencies of the sound signature. Alternatively or in addition, the engine operating conditions may be sensed by calculating a derivative of the engine RPM to determine acceleration and deceleration. If the engine is braking the vehicle's speed, such as when downshifting to slow the vehicle, the vacuum will increase and the audio filter will accentuate higher frequencies and suppress the lower frequencies. Under no-load situations, the audio filter will add no frequency filtering. The stereo output of the audio filter is passed to the audio inputs of the vehicle's stereo amplifier and then to the vehicle's speaker system.

In an alternative configuration, the sound memory includes either two or three look-up-tables containing sound signatures of an engine under different operating conditions, including loaded accelerating conditions, no-load conditions and/or decelerating conditions. The vehicle engine operating conditions are determined by manifold vacuum, by the derivative of the engine RPM and/or by an accelerometer, and the corresponding sound signature is chosen from the sound memory and processed by the audio processor. In one preferred embodiment, sound signatures are chosen from a first look-up-table and a second look-up-table and electronically summed together to produce a blended sound signature representing the sound of the engine under current operating conditions. In addition, the sound processor may use selective audio filtering to alter the tonal character of the sound signature.

DETAILED DESCRIPTION OF THE INVENTION

Figure 1:
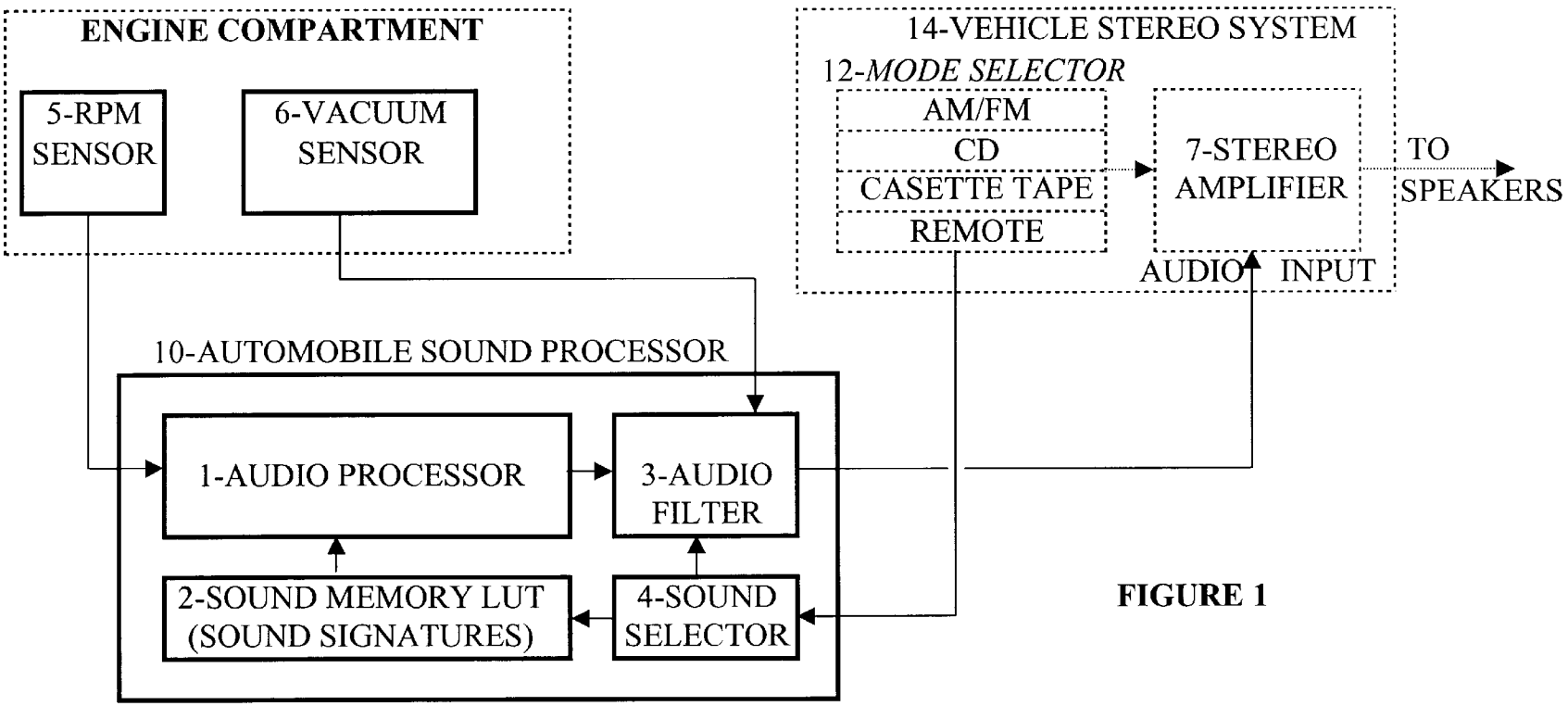
FIG. 1 shows a block diagram of the automobile sound processor of the present invention.

FIG. 1 shows a block diagram of the automobile sound processor 10 of the present invention. The automobile sound processor 10 containing prerecorded or synthesized sound signatures of vintage automobiles and motorcycles or other sounds, along with other audio processing components, is integrated with an automobile's on-board stereo sound system 14. Sensors or transducers, including an RPM sensor 5 and a vacuum/pressure sensor 6, are located in the vehicle's engine compartment to measure engine RPM and manifold vacuum. The sensors 5, 6 communicate instantaneous measurements of engine RPM and manifold vacuum to the sound processor 10 and other audio processing components. The output of the sound processor 10 would be a composite audio replication of a selected sound signature. The sound signature would be reproduced through the on-board stereo sound system 14 and modulated by the driving dynamics of the driver's car, as if the car were producing these sounds by responding to acceleration and deceleration dynamics.

The automobile sound processor 10 includes a sound memory 2 containing one or more look-up-tables programmed with unique broadband and high dynamic range sound signatures from various classic automobiles and/or motorcycles. The sound memory 2 may be implemented using one or more flash memory modules or other memory devices. The sound signatures could have been recorded from actual classic cars over an operating range from idle to maximum RPM. Each sound signature at each recorded RPM consists of a short temporal period that, when continuously replayed, sounds smooth and continuous.

The RPM sensor 5 located in the engine compartment communicates instantaneous RPM information to the audio processor 1. The audio processor 1 selects the correct signature from the sound memory 2 that corresponds to the current RPM of the vehicle's engine. It also provides logic to continuously replay periodic signatures if the RPM does not change.

The vacuum sensor 6 transforms engine manifold vacuum to an electrical signal and communicates instantaneous pressure to the audio filter 3. The audio filter 3 processes the output of the audio processor 1 to change the tonal character of the sound signature, thus reflecting the audible changes characteristic of the strain of the engine. If the engine is under load, the vacuum will decrease and the audio filter 3 will accentuate low frequencies while suppressing some of the higher frequencies of the sound signature. If the engine is braking the vehicle's speed, such as when downshifting to slow the vehicle, the vacuum will increase. In this case the audio filter 3 will accentuate higher frequencies and suppress the lower frequencies. Under no-load situations, the audio filter 3 will add no frequency filtering. The stereo output of the audio filter 3 is passed to the audio inputs of the vehicle's stereo amplifier 7 and then to the vehicle's speaker system.

The mode selector 12 of the vehicle's stereo system 14 could be used to select the desired classic car sound signature. The sound selector 4 provides unique control over the sound memory 2, audio processor 1 and audio filter 3 to customize the sound processor for the specified sound signature selected.

The RPM sensor 5 may be implemented as an induction coil that surrounds one of the spark plug wires of the vehicle engine. Alternatively, the RPM sensor 5 may detect spark plug noise signals from the 12V battery supply of the vehicle and therefore no direct connection is made to the engine electronics. The load presented to the automobile battery during spark plug firing is evident as an approximate 50 mv dip on the 12 volt supply. Since all spark plug firings are detected, a simple digital divider (the divisor depends on the number of cylinders) is used to get one timing signal for every two revolutions of the engine (equal to one engine cycle of a 4 stroke engine). This period will generally represent the sound loop length recorded at each RPM.

The sound memory 2 contains one or more look-up-tables programmed with sound signatures of the engine sounds to be replicated. Preferably, the automobile sound processor 10 is adapted to replicate actual engine sounds under three conditions: 1) no-load, 2) loaded acceleration and 3) deceleration. One method for creating and processing these various sound dynamics involves actual audio recordings throughout the RPM range for each of the three conditions of a particular engine to be simulated. In one implementation of the invention, each condition is recorded and stored digitally in three separate look-up-tables within the sound memory 2. Each sound signature in the look-up-tables is a sound loop of at least one engine cycle of the engine sound to be replicated (recorded sound for the duration of N# timing signals at each RPM) to be used for playback out of memory.

An alternative implementation of the automobile sound processor 10 uses a sound memory 2 with two look-up-tables, one for acceleration and one for deceleration. In this case the audio processor directs the blending of sound signatures from one of more memories depending on the dynamics of the host engine. An example of acceleration: Sound loops from the 'loaded acceleration'memory are blended with the 'no-load'signatures but are made audibly more dominant, proportional to the derivative of RPM acceleration. Similarly, sound loops from the 'deceleration memory'are blended with the 'no-load'signatures but are made more audibly dominant, proportional to the derivative of RPM deceleration.

The storage of sound loops from every conceivable RPM would require extensive memory. A method of sound loop quantization may be used to reduce the amount of memory required to record/digitize/store only specific sound loops at specific RPM's. An example might be to store sound loops at every 10% increase in RPM from idle to maximum engine RPM. This level of quantization would certainly reduce memory space but would not provide the realism of sound as the host engine either 'dithers'around idle or smoothly accelerates or decelerates. In order to provide more realism, the audio processor 1 would process the playback sound using 'pitch interpolated'sound loops between actual recordings. In this case, the nearest one of the recorded sound loops would be electronically shortened or lengthened, as appropriate, based on the measured RPM to create an interpolated sound loop between each of the quantized sound loops. This method of processing could be used in all playback methods described herein.

In order to detect and respond to engine dynamics, one implementation of the automobile sound processor 10 uses a combination of derivative RPM processing to detect deceleration and engine vacuum to detect engine loading. An alternative implementation is to use only derivative processing of the streaming RPM timing signals from the host automobile to determine if the engine is operating: 1) under no-load (little or no change in repeated RPM periods), 2) accelerating RPM, or 3) decelerating RPM. The appropriate sound loop(s) from the sound memory 2 are played which correspond to the current detected and derivative RPM of the host automobile's engine.

The automobile sound processor 10 of the present invention can be implemented in a number of different ways. By way of example, FIG. 2 and FIG. 3 show two possible implementations of the automobile sound processor 10 shown in FIG. 1.

Figure 2:
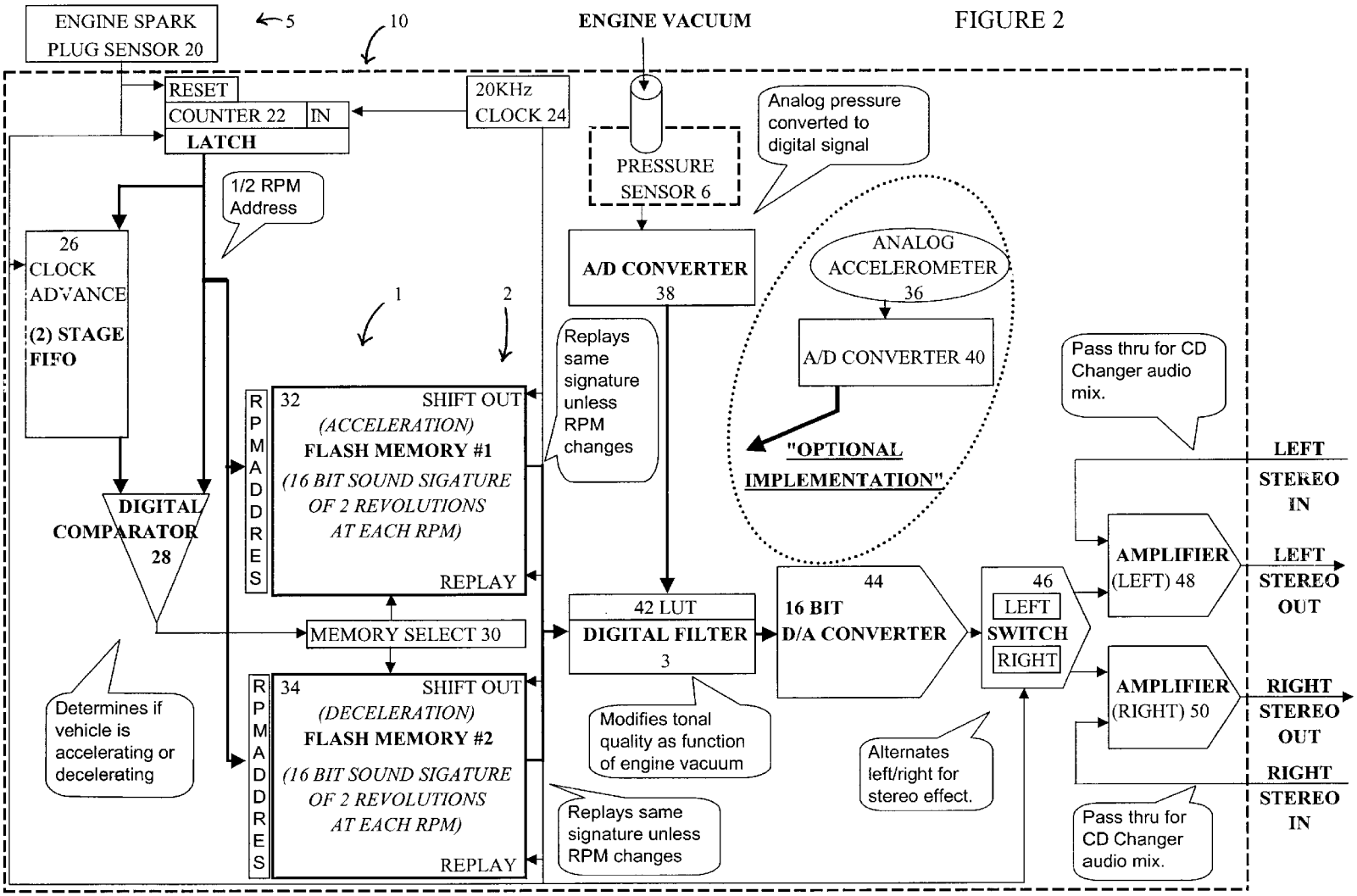
FIG. 2 shows a detailed block diagram of a first implementation of the automobile sound processor shown in FIG. 1.
Figure 3:
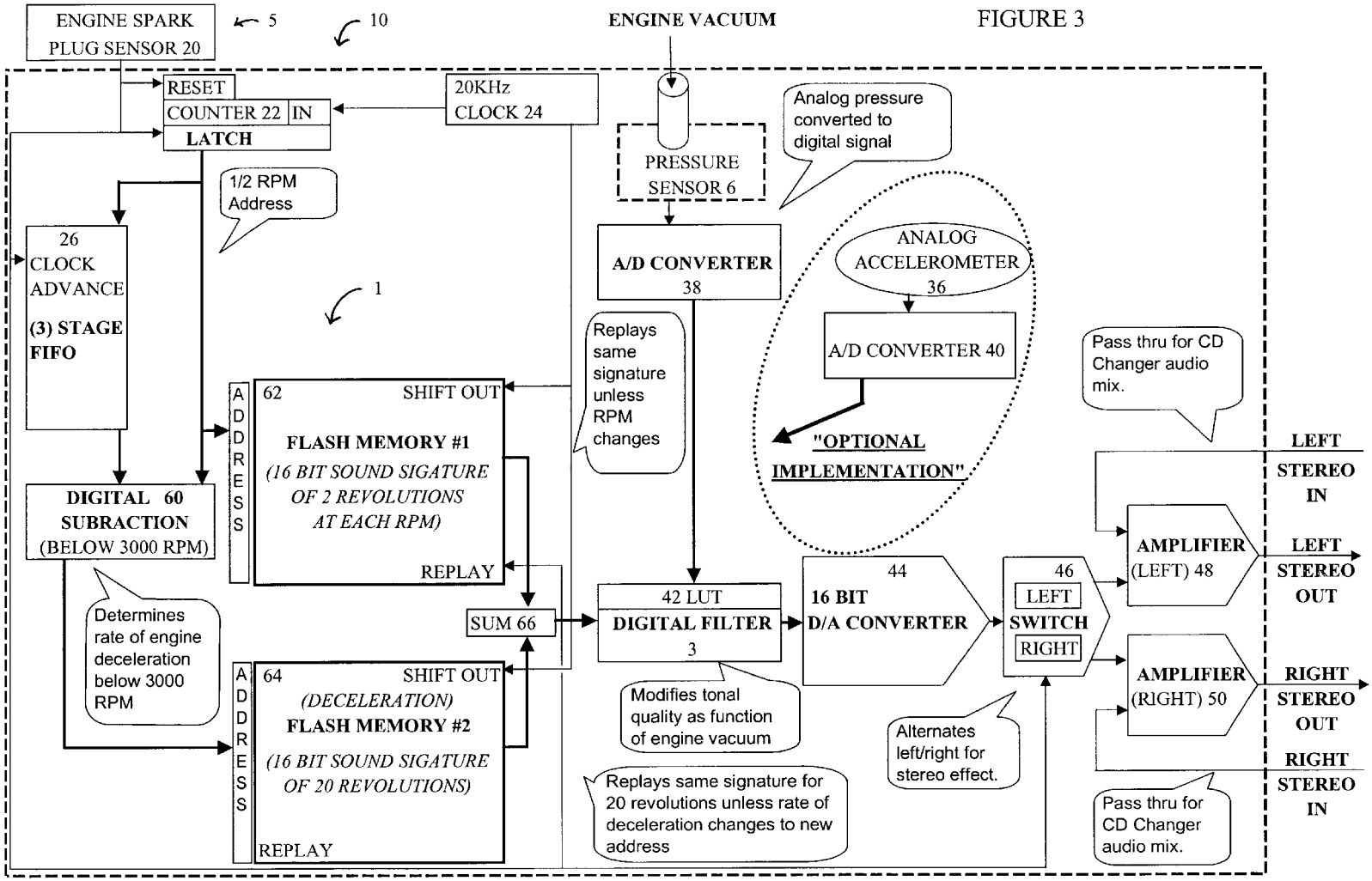
FIG. 3 shows a detailed block diagram of a second implementation of the automobile sound processor shown in FIG. 1.

FIG. 2 shows a detailed block diagram of a first implementation of the automobile sound processor 10 shown in FIG. 1. In this case, the RPM sensor 5 takes the form of an engine spark plug sensor 20 connected to a counter 22, having a latch and a reset, for determining the rotational speed of the vehicle engine. A clock chip 24, such as a 20 KHz clock chip, provides a reference for the counter 22 and the other components of the audio processor 1. The engine spark plug sensor 20 may be an induction coil that surrounds one of the spark plug wires on the vehicle engine. Alternatively, the rotational speed may be determined from the spark plug noise in the vehicle's electrical system, as described above.

A first-in-first-out (FIFO) device 26 is connected to the output of the RPM sensor 5. A digital comparator 28 receives the output of the RPM sensor 5 and of the FIFO device 26 and compares them to determine if the rotational speed of the vehicle engine is accelerating or decelerating. The output of the digital comparator 28, which indicates the sign (i.e. positive or negative) of the first derivative of the engine RPM, is connected to the input of a memory selector 30.

The automobile sound processor 10 has two look-up tables (LUT) 32, 34 containing the recorded sound signatures of the engine sounds to be replicated. Each sound signature represents the sound of one engine cycle of the engine sound to be replicated (i.e. two engine revolutions for the sound of a four-stroke engine.) The first LUT 32 contains the sound signatures of the engine under acceleration and the second LUT 34 contains the sound signatures of the engine under deceleration. Optionally, a third LUT may be provided containing sound signatures of the engine under steady RPM conditions. Physically, the LUT's may be contained in separate flash memory modules, or they may be contained in a single segmented or compartmentalized flash memory module, or the like.

The memory selector 30 selects which of the LUT's 32, 34 is active depending on whether the vehicle engine is accelerating or decelerating based on the sign of the first derivative of the engine RPM as determined by the digital comparator 28. The specific sound signature within the selected LUT to be replayed is selected based on the RPM of the vehicle engine, as determined by the counter 22. The audio processor 1 replays the selected sound signature in a continuous loop as long as the engine RPM remains constant. If the RPM changes, a different sound signature is selected from one of the LUT's 32, 34 and substituted for the previous sound signature in a smooth and continuous manner.

The output of the audio processor 1 is connected to a digital filter 3, which modifies the tonal quality of the sound signature as a function of engine load. In this case, engine load is determined by engine vacuum as measured by a pressure/vacuum sensor 6 connected to the intake manifold of the vehicle engine. An A/D converter 38 converts the analog signal of the pressure/vacuum sensor 6 to a digital signal for use by the digital filter 3. Additionally or alternatively, the engine load condition can be determined with an accelerometer 36 that measures the acceleration and deceleration of the vehicle. An A/D converter 40 converts the analog signal of the accelerometer 36 to a digital signal for use by the digital filter 3. If desired, a filter LUT 42 may provide a mapping of the relationship between engine load conditions and the filter profile of the digital filter 3, particularly if multiple input variables are used.

The output of the digital filter 3 is passed through a D/A converter 44 to produce an audio signal usable by the vehicle's on-board audio system. Optionally, a switching device 46 may be used to create a stereo audio signal. If desired, the audio signal from the automobile sound processor 10 may be mixed with the audio signals from the vehicle's on-board audio system using a left channel amplifier 48 and a right channel amplifier 50. The left channel amplifier 48 and the right channel amplifier 50 each provide a pass through for audio signals from the CD changer or other components of the vehicle's audio system so that music or other audio can be listened to simultaneously with the replicated engine sounds from the automobile sound processor 10.

FIG. 3 shows a detailed block diagram of a second implementation of the automobile sound processor 10 shown in FIG. 1. Again, the RPM sensor 5 takes the form of an engine spark plug sensor 20 connected to a counter 22 for determining the rotational speed of the vehicle engine. A clock chip 24 provides a reference for the counter 22 and the other components of the audio processor 1. The engine spark plug sensor 20 may be an induction coil that surrounds one of the spark plug wires on the vehicle engine. Alternatively, the rotational speed may be determined from the spark plug noise in the vehicle's electrical system, as described above.

A first-in-first-out (FIFO) device 26 is connected to the output of the RPM sensor 5. A digital subtraction device 60 receives the output of the RPM sensor 5 and of the FIFO device 26 and subtracts them to determine if the rotational speed of the vehicle engine is accelerating or decelerating. The output of the digital subtraction device 60 is proportional to the first derivative of the engine RPM when the engine is decelerating.

The automobile sound processor 10 has two look-up tables (LUT) 62, 64 containing the recorded sound signatures of the engine sounds to be replicated. The first LUT 62 contains sound signatures representing at least one engine cycle (two engine revolutions) of the engine under steady RPM conditions. The second LUT 64 contains sound signatures representing at least one engine cycle (two engine revolutions) of the engine under decelerating RPM conditions. Preferably, the second LUT 64 contains a sound loop of audio sampling greater than two revolutions of a characteristic engine sound recorded from a decelerating engine. In one particularly preferred embodiment, the first LUT 62 contains sound signatures of one engine cycle (two engine revolutions) under steady RPM conditions and the second LUT 64 contains sound signatures representing ten engine cycles (twenty engine revolutions) of the engine under deceleration throughout the operating range. Physically, the LUT's may be contained in separate flash memory modules, or they may be contained in a single segmented or compartmentalized flash memory module, or the like.

The audio processor 1 selects a first sound signature from the first LUT 62 to be replayed based on the engine RPM as determined by the counter 22. The audio processor 1 replays the selected first sound signature in a continuous loop as long as the engine RPM remains constant. If the RPM changes, a different sound signature is selected from the first LUT 62 and substituted for the previous sound signature in a smooth and continuous manner. The audio processor 1 also selects a second sound signature from the second LUT 64 based on the output of the digital subtraction device 60, which is proportional to the first derivative of the engine RPM during deceleration. The longer second sound signature is synchronized with the first sound signature based on the signal from the spark plug sensor 20 and replayed at a repetition rate consistent with the rate of the first sound signature. The selected second sound signature is also replayed in a continuous loop as long as the rate of deceleration remains constant. If the rate of deceleration changes, a different sound signature is selected from the second LUT 64 and substituted for the previous sound signature in a smooth and continuous manner. The first sound signature and the second sound signature are summed together by a summing device 66 to create a blended sound signature. In one particularly preferred embodiment, the digital subtraction device 60 is configured to operate only at rotational speeds below 3000 RPM, as modification of the sound signature is not as important above 3000 RPM. In addition, the volume of the second sound signature sent to the summing device 66 may be modulated based on the magnitude of the engine deceleration as determined by the digital subtraction device 60. In a preferred embodiment, the volume of the second sound signature is amplified proportionally to the engine deceleration prior to summing with the first sound signature.

The blended sound signature from the audio processor 1 is sent to a digital filter 3, which modifies the tonal quality of the sound signature as a function of engine load. In this case, engine load is determined by engine vacuum as measured by a pressure/vacuum sensor 6 connected to the intake manifold of the vehicle engine. An A/D converter 38 converts the analog signal of the pressure/vacuum sensor 6 to a digital signal for use by the digital filter 3. Additionally or alternatively, the engine load condition can be determined with an accelerometer 36 that measures the acceleration and deceleration of the vehicle. An A/D converter 40 converts the analog signal of the accelerometer 36 to a digital signal for use by the digital filter 3. If desired, a filter LUT 42 may provide a mapping of the relationship between engine load conditions and the filter profile of the digital filter 3, particularly if multiple input variables are used.

The output of the digital filter 3 is passed through a D/A converter 44 to produce an audio signal usable by the vehicle's on-board audio system. Optionally, a switching device 46 may be used to create a stereo audio signal. If desired, the audio signal from the automobile sound processor 10 may be mixed with the audio signals from the vehicle's on-board audio system using a left channel amplifier 48 and a right channel amplifier 50. The left channel amplifier 48 and the right channel amplifier 50 each provide a pass through for audio signals from the CD changer or other components of the vehicle's audio system so that music or other audio can be listened to simultaneously with the replicated engine sounds from the automobile sound processor 10.

While the present invention has been described herein with respect to the exemplary embodiments and the best mode for practicing the invention, it will be apparent to one of ordinary skill in the art that many modifications, improvements and subcombinations of the various embodiments, adaptations and variations can be made to the invention without departing from the spirit and scope thereof.

What is claimed is:

1. A sound processor for producing replicated engine sounds in response to the operating dynamics of a vehicle engine, the sound processor comprising:

a sound memory containing at least one sound signature representing at least one engine cycle of an engine sound to be replicated;

an RPM sensor for sensing a rotational speed of the vehicle engine;

an RPM derivative sensor for sensing a first derivative of the rotational speed of the vehicle engine; and an audio processor for producing an audio signal representing a replicated engine sound by continuously repeating a portion of the sound signature from the sound memory corresponding to an integer number of engine cycles, the audio processor modulating the replicated sound signature based on the rotational speed of the vehicle engine sensed by the RPM sensor by adjusting a duration and repetition rate of the portion of the sound signature corresponding to an integer number of engine cycles, wherein the audio processor modulates the audio signal based on the first derivative of the rotational speed of the vehicle engine sensed by the RPM derivative sensor.

2. The sound processor of claim 1, wherein the sound memory contains a multiplicity of sound signatures representing at least one engine cycle of the engine sound to be replicated at different rotational speeds within an operating range, wherein the audio processor selects a sound signature to be replicated from the sound memory based on the rotational speed of the vehicle engine sensed by the RPM sensor, and wherein the audio processor interpolates between different rotational speeds within the operating range by adjusting the duration and repetition rate of the portion of the selected sound signature to be replicated.

3. The sound processor of claim 1, further comprising:

an engine load condition sensor for sensing an engine load condition of the vehicle engine; and an audio filter for selectively filtering the audio signal produced by the audio processor based on the engine load condition of the vehicle engine sensed by the engine load condition sensor.

4. The sound processor of claim 3, wherein the engine load condition sensor comprises an engine manifold vacuum sensor.

5. The sound processor of claim 1, wherein the sound memory contains a first look-up table containing a multiplicity of sound signatures representing sounds of an engine operating in a first operating condition and a second look-up table containing a multiplicity of sound signatures representing sounds of the engine operating in a second operating condition, and wherein the audio processor selects a first sound signature from the first look-up table and a second sound signature from the second look-up table and blends the first sound signature and the second sound signature to produce a blended sound signature.

6. The sound processor of claim 1, wherein the sound memory contains a multiplicity of sound signatures representing engine sounds of different engines, and wherein the sound processor further comprises a means for selecting a sound signature from the sound memory to be replicated.

7. The sound processor of claim 1, further comprising at least one speaker for producing replicated engine sounds based on said audio signal.

8. A sound processor for producing replicated engine sounds in response to the operating dynamics of a vehicle engine, the sound processor comprising:

a sound memory containing at least one sound signature of an engine sound to be replicated;

an RPM sensor for sensing a rotational speed of the vehicle engine;

an RPM derivative sensor for sensing a first derivative of the rotational speed of the vehicle engine; and an audio processor for producing an audio signal representing a replicated engine sound based on the sound signature from the sound memory, the audio processor modulating the audio signal based on the rotational speed of the vehicle engine sensed by the RPM sensor and based on the first derivative of the rotational speed of the vehicle engine sensed by the RPM derivative sensor.

9. The sound processor of claim 8, wherein the audio processor modulates the audio signal by adjusting a repetition rate of the sound signature based on the rotational speed of the vehicle engine sensed by the RPM sensor.

10. The sound processor of claim 8, wherein the audio processor changes the volume of the audio signal proportional to the first derivative of the rotational speed of the vehicle engine sensed by the RPM derivative sensor.

11. The sound processor of claim 8, wherein the audio processor synchronizes the audio signal by adjusting a repetition rate of the sound signature based on the rotational speed of the vehicle engine sensed by the RPM sensor, and wherein the audio processor changes the volume of the audio signal proportional to the first derivative of the rotational speed of the vehicle engine sensed by the RPM derivative sensor.

12. The sound processor of claim 8, further comprising:

an engine load condition sensor for sensing an engine load condition of the vehicle engine; and an audio filter for selectively filtering the audio signal produced by the audio processor based on the engine load condition of the vehicle engine sensed by the engine load condition sensor.

13. The sound processor of claim 12, wherein the engine load condition sensor comprises an engine manifold vacuum sensor.

14. The sound processor of claim 8, wherein the sound memory contains a multiplicity of sound signatures representing engine sounds of different engines, and wherein the sound processor further comprises a means for selecting a sound signature from the sound memory to be replicated.

15. The sound processor of claim 8, further comprising at least one speaker for producing replicated engine sounds based on said audio signal.

16. The sound processor of claim 8, wherein the sound memory contains a first look-up table containing a multiplicity of sound signatures representing sounds of an engine operating in a first operating condition and a second look-up table containing a multiplicity of sound signatures representing sounds of the engine operating in a second operating condition, and wherein the audio processor selects a first sound signature from the first look-up table and a second sound signature from the second look-up table and blends the first sound signature and the second sound signature to produce a blended sound signature.

17. The sound processor of claim 16, wherein the audio processor modulates the audio signal by amplifying at least one of the first sound signature or the second sound signature as a function of the first derivative of the rotational speed of the vehicle engine sensed by the RPM derivative sensor.

18. A sound processor for producing replicated engine sounds in response to the operating dynamics of a vehicle engine, the sound processor comprising:

a sound memory containing at least one sound signature representing at least one engine cycle of an engine sound to be replicated, wherein the sound memory contains a first look-up table containing a multiplicity of sound signatures representing sounds of an engine operating in a first operating condition and a second look-up table containing a multiplicity of sound signatures representing sounds of the engine operating in a second operating condition;

an RPM sensor for sensing a rotational speed of the vehicle engine;

an audio processor for producing an audio signal representing a replicated engine sound by continuously repeating a portion of the sound signature from the sound memory corresponding to an integer number of engine cycles, the audio processor modulating the replicated sound signature based on the rotational speed of the vehicle engine sensed by the RPM sensor by adjusting a duration and repetition rate of the portion of the sound signature corresponding to an integer number of engine cycles, wherein the audio processor selects a first sound signature from the first look-up table and a second sound signature from the second look-up table and blends the first sound signature and the second sound signature to produce a blended sound signature.

19. The sound processor of claim 18, wherein the sound memory contains a multiplicity of sound signatures representing at least one engine cycle of the engine sound to be replicated at different rotational speeds within an operating range, wherein the audio processor selects a sound signature to be replicated from the sound memory based on the rotational speed of the vehicle engine sensed by the RPM sensor, and wherein the audio processor interpolates between different rotational speeds within the operating range by adjusting the duration and repetition rate of the portion of the selected sound signature to be replicated.

20. The sound processor of claim 18, further comprising:

an engine load condition sensor for sensing an engine load condition of the vehicle engine; and an audio filter for selectively filtering the audio signal produced by the audio processor based on the engine load condition of the vehicle engine sensed by the engine load condition sensor.

21. The sound processor of claim 20, wherein the engine load condition sensor comprises an engine manifold vacuum sensor.

22. The sound processor of claim 18, wherein the sound memory contains a multiplicity of sound signatures representing engine sounds of different engines, and wherein the sound processor further comprises a means for selecting a sound signature from the sound memory to be replicated.

23. The sound processor of claim 18, further comprising at least one speaker for producing replicated engine sounds based on said audio signal.

* * * * *